US007516946B2

(12) United States Patent
Fumagalli

(10) Patent No.: US 7,516,946 B2
(45) Date of Patent: Apr. 14, 2009

(54) INTRUSION-PREVENTION ENCLOSURE

(75) Inventor: Daniele Fumagalli, Galbiate (IT)

(73) Assignee: Satech Safety Technology S.p.A., Calco (IT)

( * ) Notice: Subject to any disclaimer, the term of this patent is extended or adjusted under 35 U.S.C. 154(b) by 339 days.

(21) Appl. No.: 11/296,457

(22) Filed: Dec. 8, 2005

(65) Prior Publication Data

US 2006/0174563 A1 Aug. 10, 2006

(30) Foreign Application Priority Data

Dec. 23, 2004 (IT) ..... BO2004A0806

(51) Int. Cl.
*E04H 17/16* (2006.01)

(52) U.S. Cl. ..... 256/65.14; 256/25; 256/28; 256/29; 52/282.5; 52/293.1; 52/274

(58) Field of Classification Search ..... 256/19, 256/21, 24, 25, 27, 28, 29, 65.14, 73; 52/281, 52/282.1, 282.4, 282.5, 239, 581, 582.1, 52/293.1, 264, 274; 24/546; 312/111, 140
See application file for complete search history.

(56) References Cited

U.S. PATENT DOCUMENTS

| | | | | | |
|---|---|---|---|---|---|
| 2,540,995 | A * | 2/1951 | Roeder | 160/229.1 |
| 4,115,938 | A * | 9/1978 | Belmuth et al. | 40/730 |
| 4,185,430 | A * | 1/1980 | Gartung | 52/239 |
| 4,239,306 | A * | 12/1980 | Klaus | 312/111 |
| 4,625,483 | A * | 12/1986 | Zacky et al. | 52/239 |
| 4,865,213 | A * | 9/1989 | Kruger | 52/281 |
| 4,942,709 | A * | 7/1990 | Waldron | 52/285.1 |
| 5,181,297 | A * | 1/1993 | Andrews et al. | 24/563 |
| 5,363,612 | A * | 11/1994 | Erickson | 52/239 |
| 6,578,827 | B2 * | 6/2003 | McCracken | 256/24 |
| 6,712,339 | B1 * | 3/2004 | Smith | 256/24 |

* cited by examiner

*Primary Examiner*—Michael P Ferguson
(74) *Attorney, Agent, or Firm*—Modiano & Associati; Alberto Josif; Daniel J. O'Byrne

(57) ABSTRACT

An intrusion-prevention enclosure comprising a plurality of modular panels, which can be mutually associated in an orderly and predefined manner so as to provide a barrier structure, comprising a plurality of elastically deformable U-shaped connectors, which can be associated with at least one pair of adjacent uprights of at least two converging panels, in order to arrange the panels mutually adjacent and lock them stably and detachably.

5 Claims, 4 Drawing Sheets

INTRUSION-PREVENTION ENCLOSURE

The present invention relates to an intrusion-prevention enclosure.

BACKGROUND OF THE INVENTION

Intrusion-prevention enclosures are known which are used to prevent indiscriminate access to specific regions on the part of individuals, animals, vehicles or others; this need usually arises from two basic reasons: preventing uncontrolled access to locations where dangerous or discomfort-causing situations occur for assigned personnel (industrial ovens, presses, more or less rapidly rotating working parts, machines with optical, acoustic, inhalable, deafening emissions), or preventing intruders from removing or damaging products, devices or equipment on sale or in operation (theft, vandalism, unauthorized or dangerous uses).

These intrusion-prevention enclosures are usually constituted by mutually associated modular panels, which are installed on supporting means which can be fixed to the ground; in the particular field, the general trend is to provide enclosures that are easy and quick to assemble.

SUMMARY OF THE INVENTION

The aim of the present invention is to meet the above-mentioned requirements, by providing an intrusion-prevention enclosure in which assembly is simple and requires short execution times.

Within this aim, an object of the present invention is to provide an enclosure that is simple, relatively easy to provide in practice, safe in use, effective in operation, and has a relatively low cost.

This aim and this and other objects that will become better apparent hereinafter are achieved by an intrusion-prevention enclosure of the type that comprises a plurality of modular panels, which can be mutually associated in an orderly and predefined manner so as to provide a barrier structure, characterized in that it comprises a plurality of elastically deformable U-shaped connectors, which can be associated with at least one pair of adjacent uprights of at least two converging panels, in order to arrange said panels mutually adjacent and lock them stably and detachably.

BRIEF DESCRIPTION OF THE DRAWINGS

Further characteristics and advantages of the invention will become better apparent from the following detailed description of a preferred but not exclusive embodiment of an intrusion-prevention enclosure according to the invention, illustrated by way of non-limiting example in the accompanying drawings, wherein.

DESCRIPTION OF THE PREFERRED EMBODIMENTS

Figure 1:
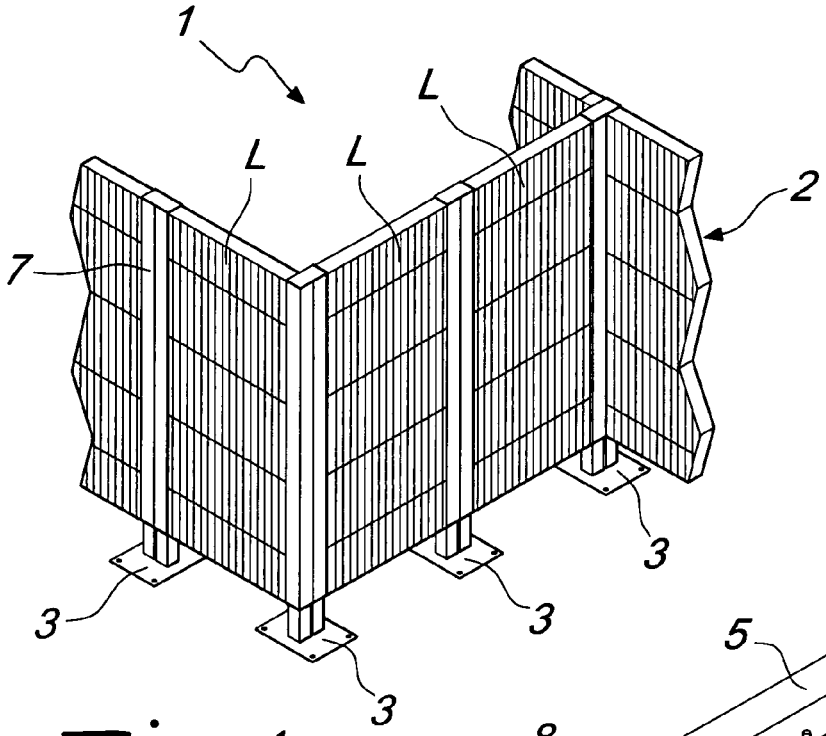
FIG. 1 is a perspective view of a portion of intrusion-prevention enclosure according to the invention.
Figure 2:
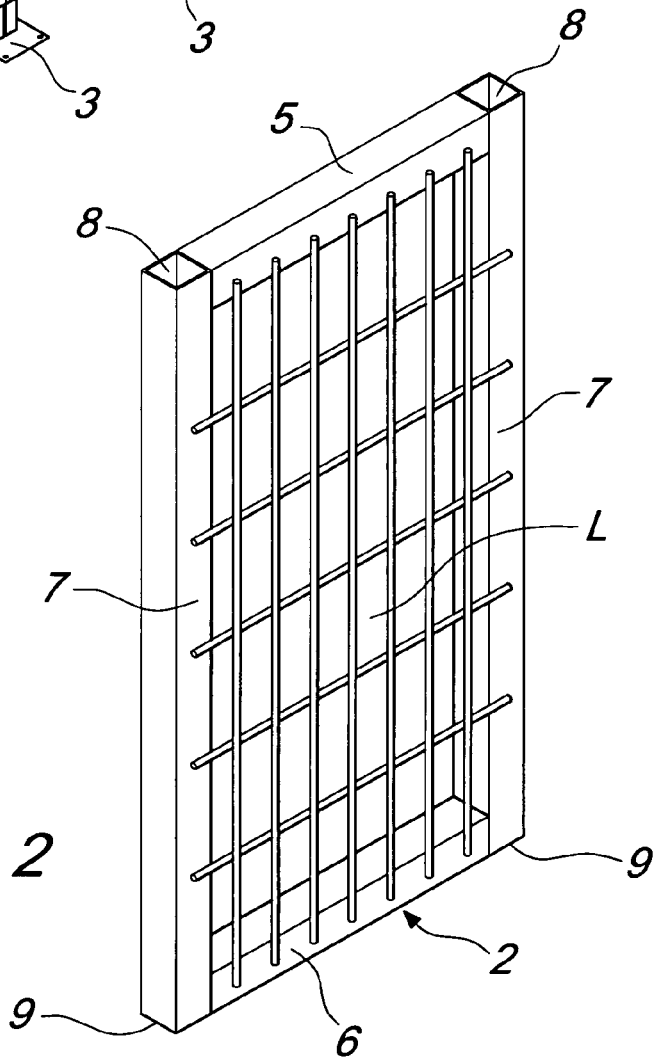
FIG. 2 is a perspective view of a panel of an enclosure.
Figure 3:
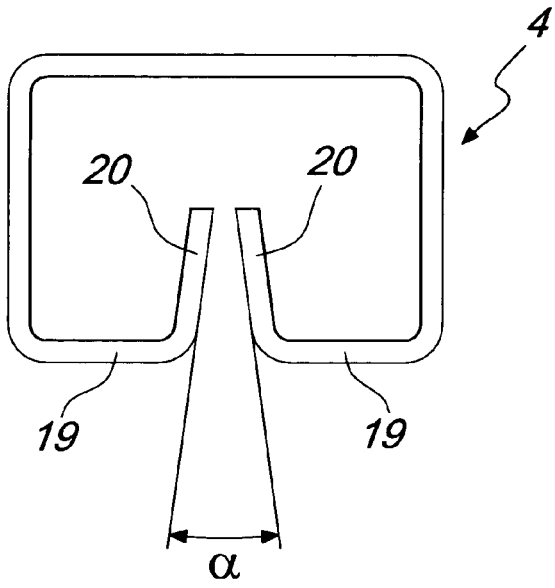
FIG. 3 is a side elevation view of a U-shaped connector.

With reference to the figures, the reference numeral 1 generally designates an intrusion-prevention enclosure, which comprises a plurality of modular panels 2, a plurality of stands 3, and a plurality of elastically deformable U-shaped connectors 4, which are assembled in a predefined orderly fashion so as to provide a barrier structure which is arranged conveniently according to the requirements.

The panels 2 have a preferably rectangular opening L made of a material such as for example metal mesh with wires that are welded electrically at the nodes and along the perimeter, which is delimited by metallic profiled elements having a tubular cross-section, which comprise an upper cross-member 5 and a lower cross-member 6, which are butt-welded at their sides against the sides of two lateral uprights 7 of the panel, so that the two uprights 7 have open upper ends 8 and open lower ends 9. The panels 2 can reach even substantial sizes, and in one provided embodiment they have horizontal wires that are more widely spaced than the vertical ones.

Figure 6:
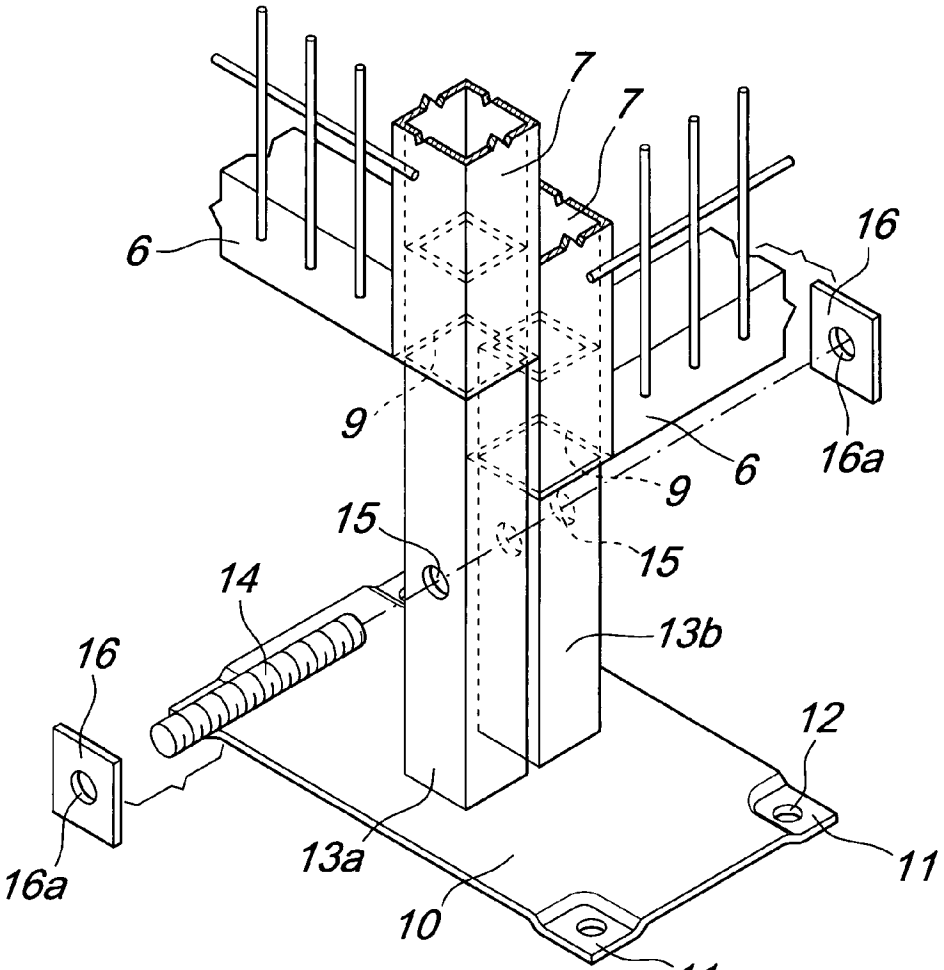
FIG. 6 is a perspective view of the stand of FIG. 5 associated with two panels.
Figure 5:
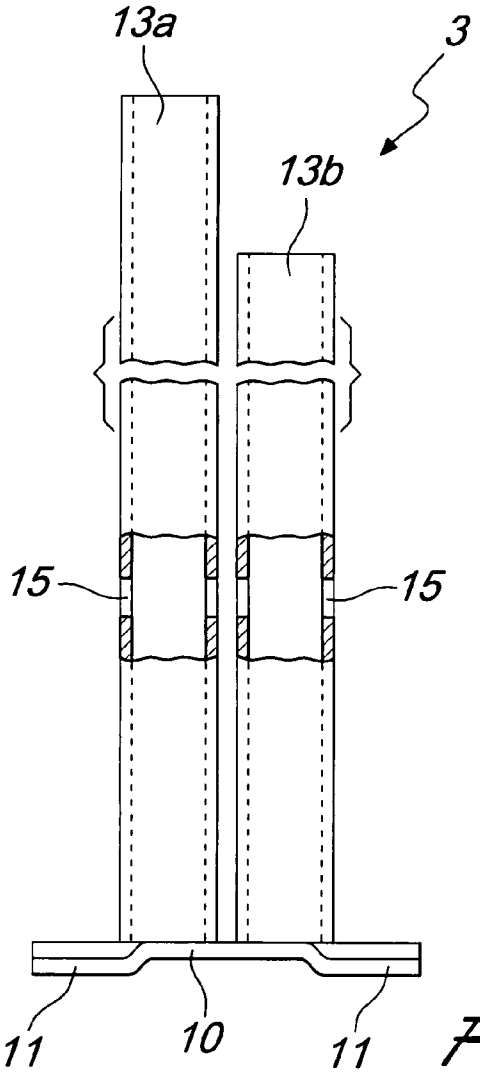
FIG. 5 is a side elevation view of a stand of an intrusion-prevention enclosure according to the invention.
Figure 7:
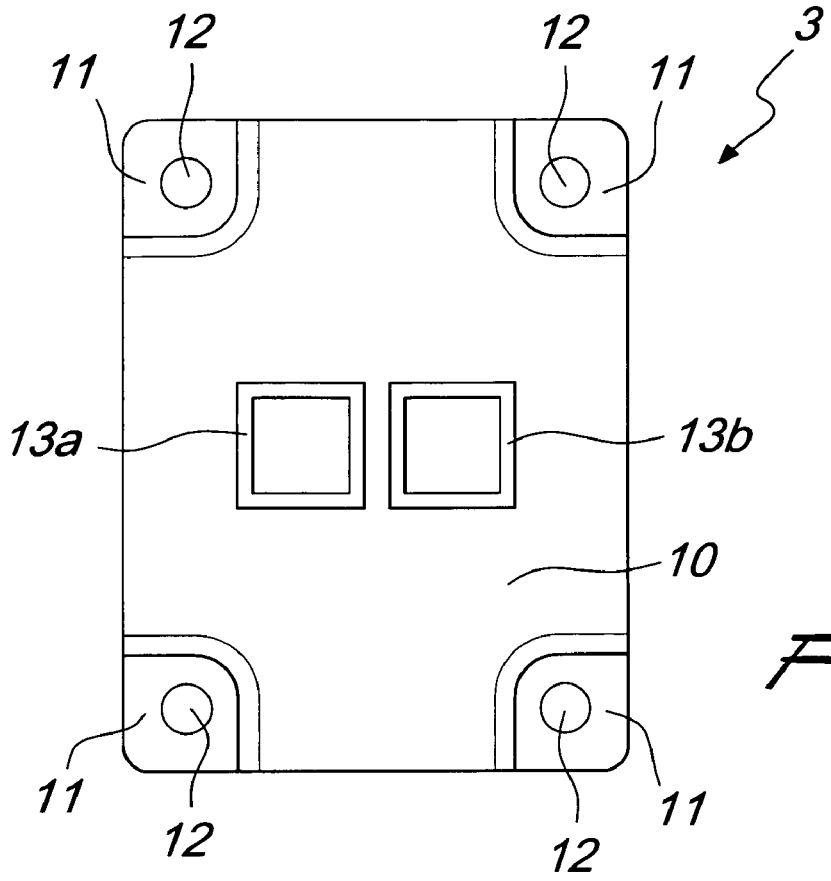
FIG. 7 is a top view of the stand of FIG. 5.

As shown in FIG. 6, the panels 2 can be mounted on the stands 3, which are constituted by a rectangular supporting base 10 which is provided with rounded and drawn corners 11 affected by respective slots 12 for the optional fixing of the stand 3 to the ground by means of nails, screws or the like.

Positively, the drawn corners 11 allow optimum adaptation of the base 8 to the ground, which is often not flat but uneven.

In an upper region, the base 10 of the stand 3 has two legs welded thereto; said legs have a substantially square transverse cross-section, are mutually parallel and are slightly spaced.

Advantageously, in a particular embodiment, the first leg 13*a* is longer than the second leg 13*b* in order to facilitate the installation thereon of the open lower ends 9 of the adjacent uprights 7 of two converging panels 2.

Adjustment means are provided for adjusting the levels at which two panels are fixed to a stand; such means are constituted by a screw 14, which passes through openings 15 provided in the two legs 13*a*, 13*b* of the stand 3: two locking plates 16 are screwed onto the screw 14 and are affected by threaded holes 16*a*, which upon screwing clamp against each other the contiguous faces of the pair of legs 13*a*, 13*b* in which the uprights 7 of the two panels 2 are inserted above the screw 14, each arranged at any height with respect to the stand 3 and with respect to the other panel 2. Advantageously, the screw 14 and the plates 16 allow to fasten together the contiguous faces of the two uprights 7 in order to clamp the panels 2 at any relative height of the stand 3 without deforming its legs 13*a*, 13*b*.

Figure 8:
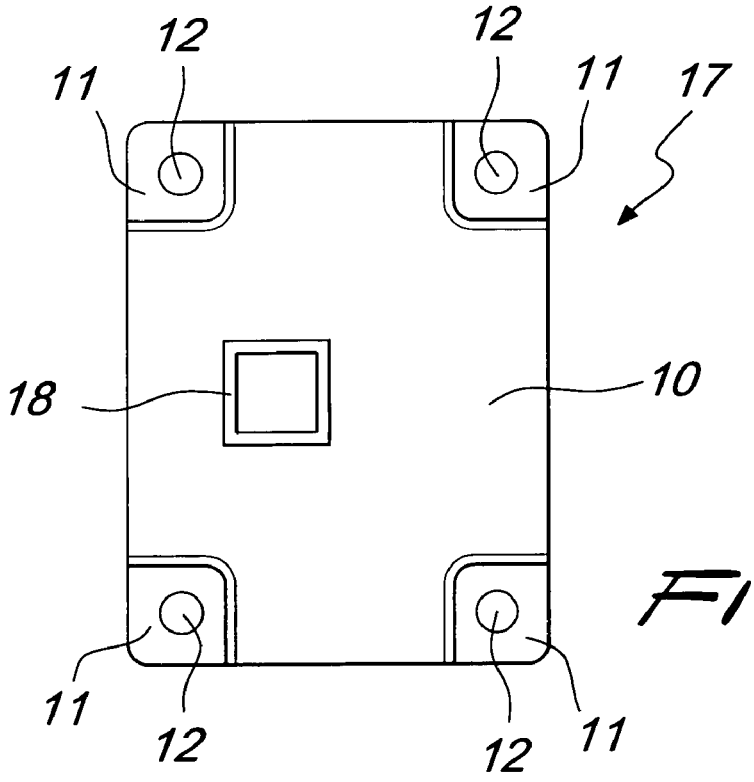
FIG. 8 is a top view of a second stand of an intrusion-prevention enclosure according to the invention.

A second stand 17 with a single leg 18, shown in FIG. 8, is provided to be assembled at the end sides of the enclosure 1.

In an upper region, the panels 2 installed on the stand 3 are retained so as to be mutually adjacent and stably and detachably locked by a U-shaped connector 4, which is elastically deformable and can be inserted within the open upper ends 8 of the uprights 7.

The U-shaped connector 4 is constituted by a lamina, which is substantially folded into a C-shape with hooks and is elastically deformable; each one of the hook-shaped portions 19 of the C-shape comprises a folded end wing 20 and the wings 20 are inclined so as to converge in a mirror-symmetrical fashion toward the inside of said C-shape according to a predefined angle $\alpha$, which is preferably equal to 14°.

The U-shaped connector 4 has dimensions suitable for its insertion, from the open side of the C-shape, with each hook-shaped portion 19 within a respective open upper end 8 of the adjacent uprights 7 of two converging panels 2, with the wings 20 pushed elastically into engagement against the internal walls of the uprights 7; in this manner, the wings 20, which are advantageously inclined at the predefined angle α, prevent the unintended extraction of the U-shaped connector 4, which keeps the uprights 7 of the converging panels 2 adjacent and stably and detachably locked without requiring additional fixing means such as screws, bolts or the like.

In practical operation, the operator first installs the panels 2 on the stand 3, inserting an open lower end 9 of an upright 7 of a panel 2 in the higher leg 13*a* and then an open lower end 9 of an upright 7 of the converging panel 2 in the lower leg 13*b*; it should be noted that the different height of the two legs 13*a*, 13*b* facilitates the assembly of the panels 2, since it allows the operator to align one at a time, without having to pay attention simultaneously to both, as would occur if they had the same height.

Once the uprights 7 have been inserted in the legs 13*a*, 13*b* of the stand 2, the plates 16 are conveniently fastened onto the screw 14 in order to rigidly couple the two panels 2 to the stand 3 at the chosen relative heights.

In an upper region, the converging panels 2, arranged on the stand 3 so that they are coplanar or oriented at right angles with respect to each other as required, are conveniently retained so that they are mutually adjacent and detachably and stably locked by the U-shaped connector 4, which is inserted in the open upper ends 8 of the adjacent uprights 9 so that the wings 20 are pushed elastically in engagement against their internal walls.

Figure 4:
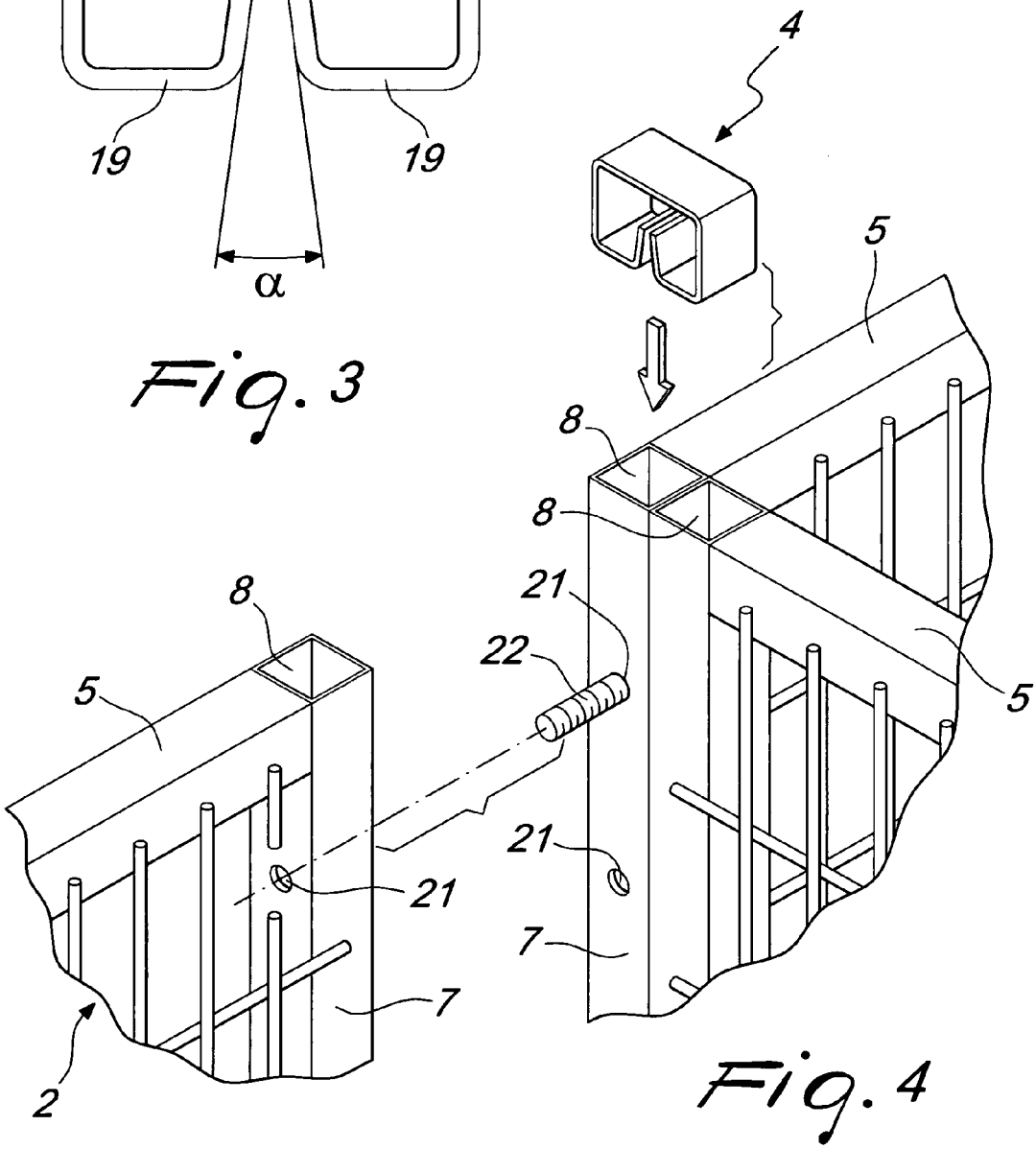
FIG. 4 is an enlarged-scale perspective view of a detail of an intrusion-prevention enclosure according to the invention.

Advantageously, the uprights 7 have a plurality of laterally distributed holes 21 for fixing, when two panels 2 are installed in pairs on a stand 3, a third panel 2, as shown in FIG. 4; the fixing of the third panel 2 occurs by way of provided connection means 22, for example of the screw type.

In practice it has been found that the invention fully achieves the intended aim and object, since the intrusion-prevention enclosure 1, advantageously constituted by a small number of components which can be assembled conveniently, is quick and easy to assemble, with evident gains in economic terms and in terms of installation time.

The invention thus conceived is susceptible of numerous modifications and variations, all of which are within the scope of the appended claims.

All the details may further be replaced with other technically equivalent ones.

In the examples of embodiment shown, individual characteristics, given in relation to specific examples, may actually be interchanged with other different characteristics that exist in other examples of embodiment.

Moreover, it is noted that anything found to be already known during the patenting process is understood not to be claimed and to be the subject of a disclaimer.

In practice, the materials used, as well as the shapes and the dimensions, may be any according to requirements without thereby abandoning the scope of the protection of the appended claims.

The disclosures in Italian Patent Application No. BO2004A000806 from which this application claims priority are incorporated herein by reference.

What is claimed is:

1. An intrusion-prevention enclosure comprising:

a plurality of modular panels provided each with respective uprights and which are mutually associatable in an orderly and predefined manner to provide a barrier structure;

a plurality of elastically deformable U-shaped connectors, which are connectable with at least one pair of adjacent ones of said uprights of at least two said panels, in order to provide arrangement of said panels mutually adjacent and in a converging manner and lock the panels stably and detachably;

a plurality of ground support stands, each of which rigidly supports, in an upper region thereof, at least one pair of legs, which are arranged parallel and are adapted to be associated with at least one pair of adjacent ones of said uprights of two converging panels, said legs being further arranged mutually spaced and having different heights in order to allow easy connection to said uprights;

adjustment means for adjusting levels of said panels at heights at which the panels are fixed to said stands;

wherein each one of said legs of a said stand is insertable in an open lower end of an upright of one of two converging ones of said panels; and wherein said adjustment means comprise: a screw, which passes through aligned openings provided in said pair of two legs of said stand; and two clamping plates, which are provided with threaded holes, are screwed onto said screw and are adapted to fasten against each other contiguous faces of two uprights in order to clamp said panels at any selected level provided by a relative height of said stand.

2. The intrusion-prevention enclosure of claim 1, wherein each one of said elastically deformable U-shaped connectors is constituted by a lamina which is folded substantially in a C-shape with hook-shaped ends, each one of the hook-shaped ends thereof being insertable in an open upper end of a respective upright of one of two converging panels and comprising a respective end wing, which is folded and is engageable elastically against an internal wall of the upright in which it is inserted, said wings being further inclined so as to converge in a mirror-symmetrical fashion toward an inside part of said C-shape at a preset angle, in order to provide the adjacent arrangement and detachable stable locking of said converging panels.

3. The intrusion-prevention enclosure of claim 2, wherein said preset angle is substantially of 14°.

4. The enclosure of claim 1, comprising removable connection means, said uprights being provided with a plurality of laterally distributed holes for fixing, when panels are installed in pairs on said stand, a third one of said panels by way of said removable connection means.

5. The enclosure of claim 4, wherein said panels have each an opening which has a substantially rectangular shape and perimeter that is delimited by an upper cross-member and a lower cross-member thereof, said cross-members being associated with sides of said uprights that comprise said open upper ends and said open lower ends of the uprights.

* * * * *